US006321473B1

(12) United States Patent
Klabunde

(10) Patent No.: US 6,321,473 B1
(45) Date of Patent: Nov. 27, 2001

(54) COUPON VEHICLE FOR NECKED CONTAINERS

(76) Inventor: Michael Paul Klabunde, 225 Arcwood Rd., Mahtomedi, MN (US) 55115

( * ) Notice: Subject to any disclaimer, the term of this patent is extended or adjusted under 35 U.S.C. 154(b) by 0 days.

(21) Appl. No.: 09/600,040

(22) PCT Filed: Dec. 9, 1999

(86) PCT No.: PCT/US99/29245

§ 371 Date: Jul. 10, 2000

§ 102(e) Date: Jul. 10, 2000

(87) PCT Pub. No.: WO00/34938

PCT Pub. Date: Jun. 15, 2000

(51) Int. Cl.[7] ..... G09F 3/00
(52) U.S. Cl. ..... 40/310; 40/673
(58) Field of Search ..... 40/299.01, 306, 40/310, 322, 661.05, 673; D20/22, 28; 215/365

(56) References Cited

U.S. PATENT DOCUMENTS

| | | | | |
|---|---|---|---|---|
| D. 68,845 | | 11/1925 | Barry . | |
| D. 89,072 | | 1/1933 | Neher . | |
| D. 370,386 | | 6/1996 | Pallesen . | |
| D. 408,855 | * | 4/1999 | Ho | D19/52 |
| 1,353,531 | | 9/1920 | Heard . | |
| 1,682,106 | * | 8/1928 | Banks | 40/322 |
| 1,796,398 | | 3/1931 | Richardson . | |
| 2,007,685 | | 7/1935 | Lyle . | |
| 2,138,361 | * | 11/1938 | Snelling | 40/310 |
| 2,219,562 | * | 10/1940 | Painter | 40/310 |
| 2,324,093 | * | 7/1943 | Lhamon | 40/322 X |
| 2,755,584 | * | 7/1956 | Paige | 40/310 |
| 3,423,861 | | 1/1969 | Forsyth . | |
| 3,831,300 | | 8/1974 | Berkhouse . | |
| 4,197,984 | | 4/1980 | Hartman et al. . | |
| 4,847,130 | | 7/1989 | Cooper . | |
| 5,289,650 | | 3/1994 | Follet et al. . | |
| 5,348,156 | | 9/1994 | Maroszek et al. . | |
| 5,390,435 | | 2/1995 | Grody . | |
| 5,555,655 | | 9/1996 | Yager . | |
| 5,826,356 | | 10/1998 | Lapp . | |
| 5,943,804 | * | 8/1999 | Linquist et al. | 40/673 X |
| 5,947,672 | | 9/1999 | Cohen . | |

OTHER PUBLICATIONS

Patent Abstracts of Japan; Publication No.: 08301338; Pub. Date: Nov. 19, 1996; Title: Bottle Holder; Applicant: Sanwa Shigyo KK; Inventor: Enami Zengoro; Published by: JPO.

* cited by examiner

*Primary Examiner*—Brian K. Green
(74) *Attorney, Agent, or Firm*—Steven J. Kotula

(57) ABSTRACT

A coupon vehicle for necked containers comprising a body having a central aperture for receiving the neck of a container and at least one line of perforations extending from the outer edge of the body to the central aperture. The perforations allow the body to be fractured so that the entire coupon vehicle can then easily be removed from the neck of the container. In the preferred embodiment the body is flat and disk-shaped, and has two lines of diametrically opposed perforations that facilitate separating the body into two uniform portions which can be used for separate purposes. The body preferably has a plurality of slits extending radially from the central aperture which form flaps that flex during installation and securely attach the coupon vehicle to the container. In alternate embodiments, at least one line of perforations extends from the outer edge to at least one slit.

30 Claims, 3 Drawing Sheets

COUPON VEHICLE FOR NECKED CONTAINERS

This application is a 371 of PCT/US99/29245 filed on Dec. 9, 1999.

BACKGROUND OF THE INVENTION

1. Field of the Invention.

The present invention relates, generally, to promotional material for retail products. More particularly, the invention relates to coupons applied to necked containers, such as milk bottles.

2. Background Information.

The state of the art includes various coupons and display cards for retail products. The coupons offer consumers a discount on a product featured on the coupon. A coupon can substantially boost sales of a featured product, and lead to subsequent purchases of that product by a consumer, or purchases of related products. Paper coupons are printed in product advertising such as newspapers, magazines, supplements, and mailings. Coupons can be included in a product, such as dry cereal, or they may by included in a product's packaging. Paper board packaging easily facilitates printing coupons on it, and packaging that uses plastic wrap allows a coupon to be placed under the wrap.

Packaging for liquids does not as easily provide for coupons, especially for beverages such as milk, juice and carbonated beverages that are packaged in plastic or glass bottles. These packages typically have a paper label adhesively affixed to the plastic or glass container. In the past, coupons have been printed on the label of such containers, but to use such a coupon, a consumer must remove the label from the container. Since the label is intended to stay affixed to the container, this is difficult to do without mutilating the coupon. Coupons have also been adhesively affixed to the label, which can allow easier removal of the coupon, but such a coupon can obscure at least a portion of the label. Labels on liquid containers typically do not have much extra room which can be covered by a coupon.

Several patents disclose coupon or display vehicles having an aperture with radial slits extending therefrom for fitting over the top of a necked container. In U.S. Pat. No. 5,826,356 to Lapp, the aperture is larger than the neck of the container so that the coupon vehicle rests on the container below the neck and is not necessarily secured to the neck. The slits are for the purpose of facilitating the deformation and collapsing of the hole as the coupon vehicle is passed over the cap for engagement with the neck of a capped beverage container. The coupons themselves are of rectangular configuration and folded among themselves or contained in separate envelopes attached to the vehicle.

U.S. Pat. No. 5,390,435 to Grody, U.S. Pat. No. 5,348,156 to Maroszek et al., and U.S. Pat. No. 5,289,650 to Follett also disclose devices with the similar apertures and radial slits for the same purpose.

U.S. Pat. No. 4,197,984 to Hartman et al. discloses an aperture with slits that allow a tab or flap to be punched out of the device when it is inserted over a bottle neck, but the flaps are folded significantly up against the neck of the bottle and may not necessarily hold the device securely on the neck, of the bottle.

The U.S. Pat. No. 3,423,861 to Forsythe discloses a card with an aperture for the neck which is smaller than the neck of the container, and which has a single locking flap to exert a ratchet-like grip against the neck below the cap so as to resist upward movement of the card on the container neck.

The Lapp, Hartman, and Forsythe patents also disclose at least one line of perforations which allows portions of the coupon vehicle to be separated from one another but those lines of perforations do not pass through the central aperture. When the usable coupons are separated from the coupon vehicle, a portion of the vehicle remains attached to the container. As these containers are recycled, this remaining portion of the coupon vehicle must be separately removed and disposed of.

None of the patents above disclose a disk-shaped coupon vehicle. U.S. Pat. No. 1,353,531 to Heard discloses a disk-shaped marking card for milk bottles. The card has a central aperture with tongues which bear yieldingly on the neck and can abut against the bead to prevent accidental removal of the card from the neck, but it does not fit snugly against the top of the bottle. The card is not intended to be separated into portions and does not have any lines of perforations.

Applicant's invention provides a coupon vehicle for necked containers which overcomes the limitations and shortcomings of the prior art.

BRIEF SUMMARY OF THE INVENTION

The present invention provides a coupon vehicle for necked containers which comprises a body having an outer edge, a central aperture having a diameter suitable for receiving the neck of a container onto which the coupon vehicle is installed, and at least one line of perforations extending from the outer edge to the central aperture. The body is preferably flat and disk-shaped, and preferably has a plurality of slits extending radially from the central aperture which form flaps that flex when the coupon vehicle is installed on the neck of a container. The central aperture has a diameter which preferably is slightly smaller than that of the neck of the container, thereby providing for the flaps to remain slightly flexed to securely attach the coupon vehicle to the container when the coupon vehicle is properly positioned on the neck of the container after installation.

The perforations allow the body to be fractured at the perforation line(s) so that the entire coupon vehicle can then easily be removed from the neck of the container. Preferably there are two lines of perforations that facilitate separating the body into two portions which can be used for separate purposes.

The features, benefits and objects of this invention will become clear to those skilled in the art by reference to the following description, claims and drawings.

DETAILED DESCRIPTION

Figure 1:
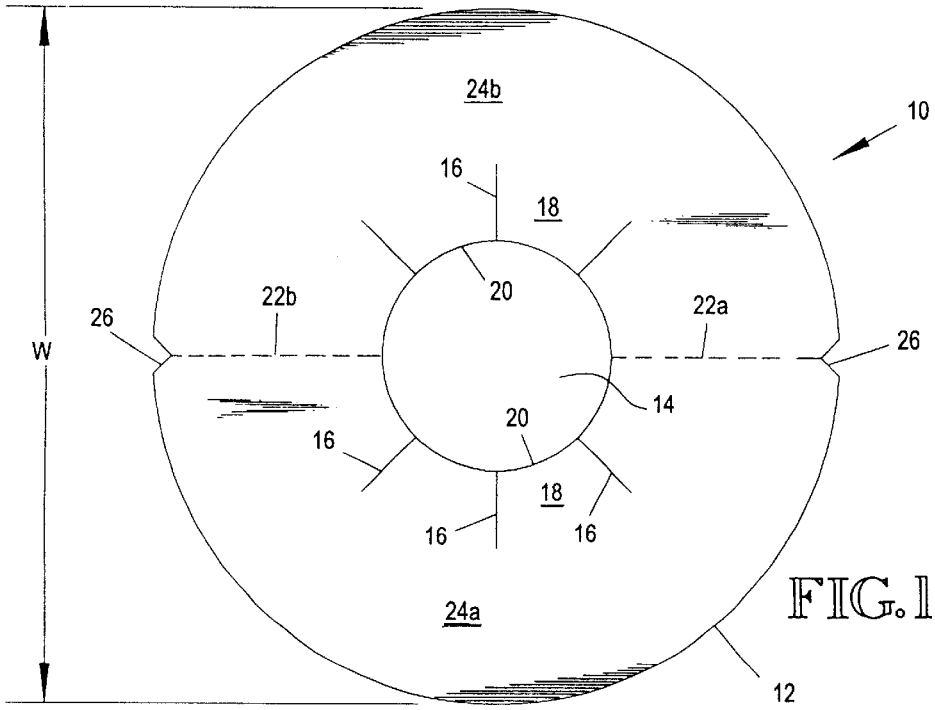
FIG. 1 is a plan view of the preferred embodiment of a coupon vehicle of the present invention.

Referring to FIG. 1, an example of the preferred embodiment of the present invention is illustrated and generally indicated by the reference numeral 10. The coupon vehicle 10 is a body 12 preferably made of synthetic moisture resistant paper or similar material which allows printing on it, and will be suitable for the environment in which it will be used, such as a dairy department at a grocery store. Body 12 is preferably flit, but may have any other suitable shape such as a cone or spherical sector. It is also preferably has a round disk shape, but it may be any suitable shape such as oval, square, rectangular, hexagonal, or octagonal, some of which are illustrated in FIGS. 8A–8D.

Referring to FIG. 1, an example of the preferred embodiment of the present invention is illustrated and generally indicated by the reference numeral 10. The coupon vehicle 10 is a body 12 preferably made of synthetic moisture resistant paper or similar material which allows printing on it, and will be suitable for the environment in which it will be used, such as a dairy department at a grocery store. Body 12 is preferably flat, but may have any other suitable shape such as a cone or spherical sector. It is also preferably has a round disk shape, but it may be any suitable shape such as oval, square, rectangular, hexagonal, or octagonal.

Figure 2:
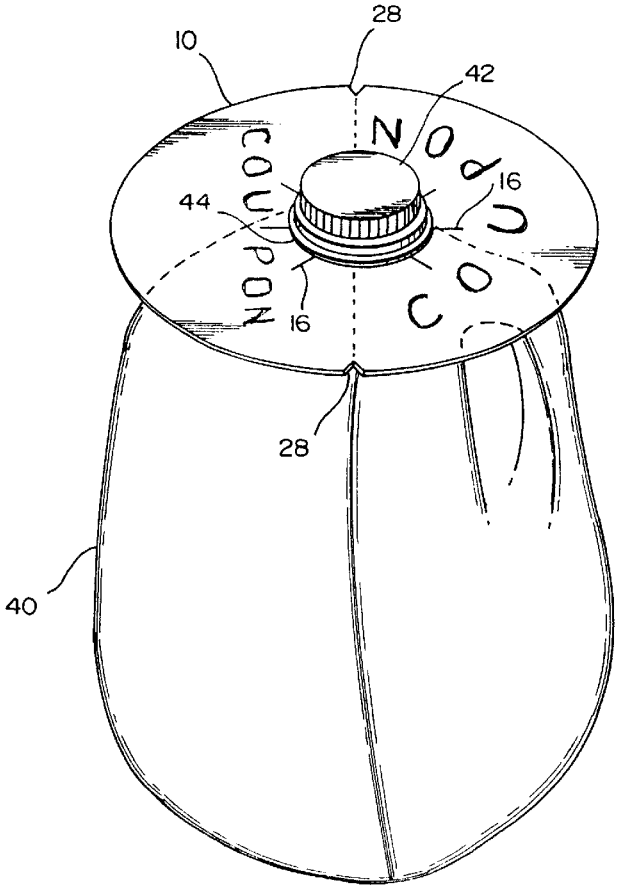
FIG. 2 is perspective view of a milk jug with a coupon vehicle of the present invention installed on its neck.

Referring to FIGS. 1 and 2, body 12 has a central aperture 14 that is preferably circular and of a diameter suitable for placement of coupon vehicle 10 onto a neck of a container 40, such as a milk jug, juice, carbonated beverage or water bottle, motor oil bottle, or the like. Aperture 14 cooperates with the neck of a container so that the coupon vehicle is preferably securely attached to the container when installed on the container. Body 12 preferably has a plurality of slits 16 preferably extending radially outward from aperture 14. Flaps 18 are bounded by two adjacent slits 16 and a portion of edge 20 of aperture 14. Slits 16 allow flaps 18 to flex as coupon vehicle 10 is installed onto a neck of a beverage container. Preferably, aperture 14 has a diameter slightly less than that of the neck of the container on which it is to be installed, thereby providing for flaps 18 to remain slightly flexed upward when coupon vehicle 10 is properly positioned on the neck of the beverage container after installation.

Alternatively, the diameter of aperture 14 may be equal to or slightly greater than the neck of the container on which it is to be installed allowing the coupon vehicle 10 to fit less tightly on the neck of the container. In that case, the diameter of aperture 14 should be smaller than the diameter of the ridge 44, if present, or cap 42 of the container so that the coupon vehicle is retained on the neck of the container by the ridge 44 or cap 42.

The number of slits 16 may vary depending on the type of material used for body 12 and the diameter of aperture 14. For installation on one-gallon milk jugs, aperture 14 preferably has a diameter of 1.5 inches, and slits 16 are six in number and have a length of ½ inch. If the material of body 12 is sufficiently resilient, no slits 16 may be needed, but for material such as moisture resistant synthetic paper, four to eight slits 16 are preferred.

Figure 3:
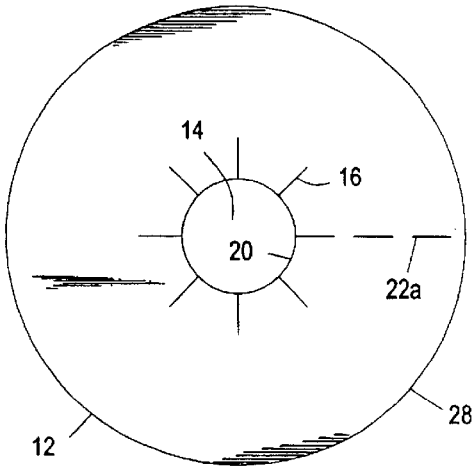
FIG. 3 is a plan view of an alternate embodiment of the coupon vehicle having a single line of perforations.

Referring to FIGS. 1–3, body 12 has at least one line of perforations 22*a*, that allow body 12 to be fractured thereat so that the entire coupon vehicle 10 can then easily be removed from the neck of the container. As installed on the neck of the container body 12 is not folded along the at least one line of perforations. The line of perforations preferably extends from the outer edge 28 of body 12 to edge 20 of aperture 14. If body 12 has only one line of perforations 22*a*, as in FIG. 3, the coupon vehicle 10 may still be used for multiple coupons requiring the consumer two cut the coupon vehicle 10 into portions.

Preferably there are two lines of perforations 22*a* and 22*b* that facilitate separating body 12 into two portions 24*a* and 24*b*. This allows each portion 24*a* and 24*b* to be used for separate purposes. For example, one portion 24*a* may be redeemed at the time of purchase of a product onto which coupon vehicle 10 is installed, and the other portion 24*b* may be retained by the consumer for redemption at a later time. This allows two separate coupons, which may have different sponsors, to be present on one coupon vehicle.

In the preferred embodiment of the FIG. 1, lines of perforations 22*a* and 22*b* are preferably straight and preferably bisect body 12 and aperture 14.

Figure 4:
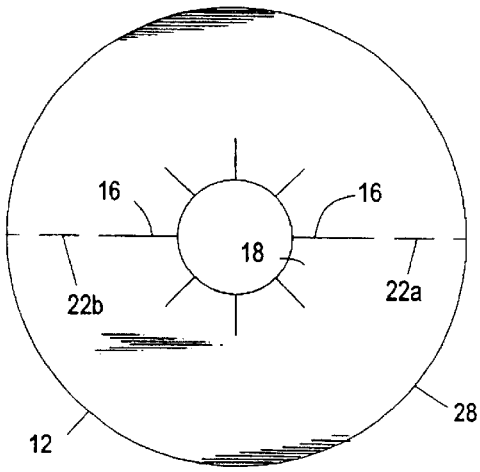
FIG. 4 is a plan view of an alternate embodiment of the coupon vehicle having two lines of perforations diametrically opposed and aligning with slits.

Referring to FIGS. 4–7, the line or lines of perforations may alternatively extend from the outer edge 28 to a slit 16. FIG. 4 illustrates an embodiment where the lines of perforations 22*a* and 22*b* are diametrically opposed and align with slits 16. Such a configuration allows greater flexibility of flaps 18 adjacent lines of perforations. However, flaps 18 are sufficiently flexible, as in FIGS. 1 and 3, to allow proper installation without a slit at the location of lines of perforations.

Figure 5:
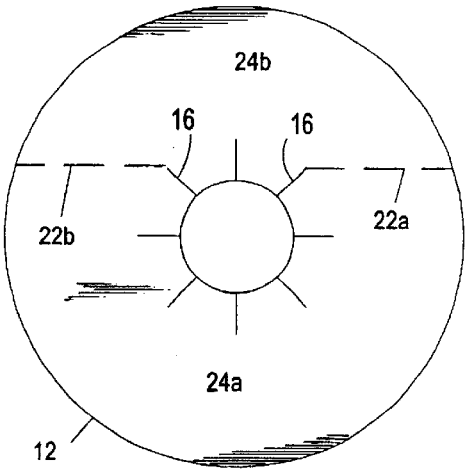
FIG. 5 is a plan view of an alternate embodiment of the coupon vehicle having two lines of perforations connecting with slits and not diametrically opposed, and which allow the coupon vehicle to be separated into two portions of non uniform size.

FIG. 5 illustrates an embodiment where the lines of perforations 22*a* and 22*b* do not align with slits 16, and portions 24*a* and 24*b* are of unequal size.

Figure 6:
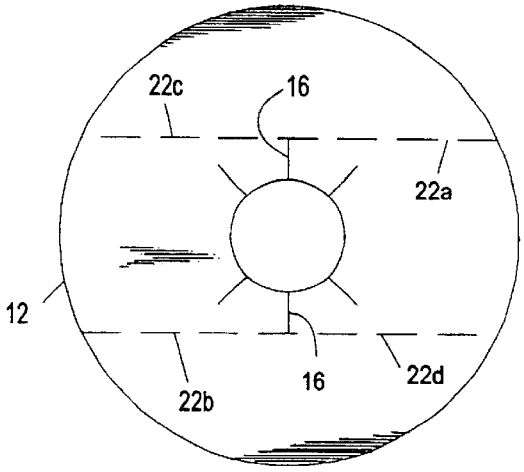
FIG. 6 is a plan view of an alternate embodiment of the coupon vehicle having more than two lines of perforations connecting to slits and which allow the coupon vehicle to be separated into more than two non-uniform sized portions.
Figure 7:
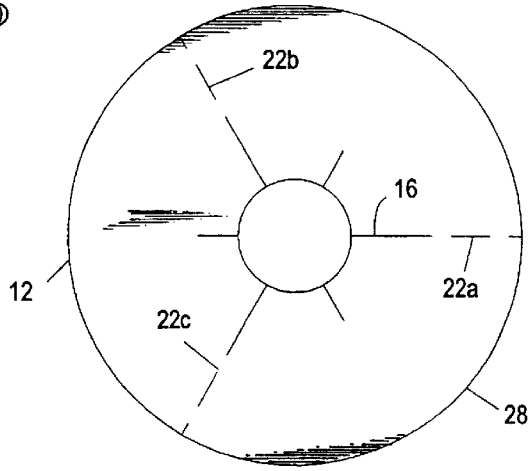
FIG. 7 is a plan view of an alternate embodiment of the coupon vehicle having more than two lines of perforations uniformly distributed which allow the coupon vehicle to be separated into uniform sized portions.
Figure 8A:
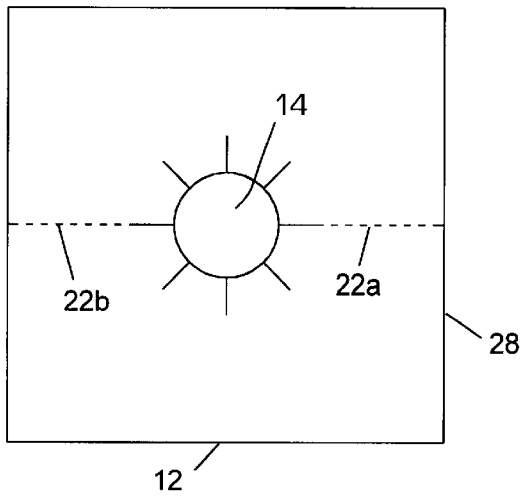
FIGS. 8A–8D are plan views of embodiments of the coupon vehicle having various outer shapes.
Figure 8B:
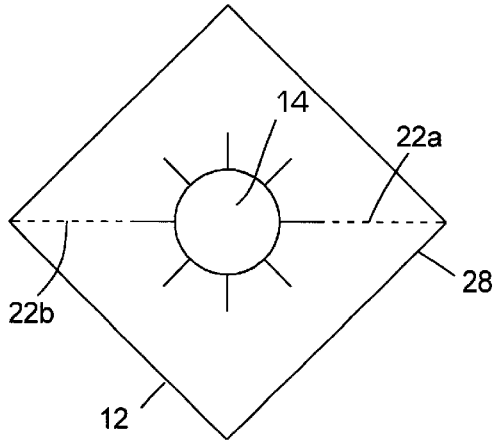
Figure 8C:
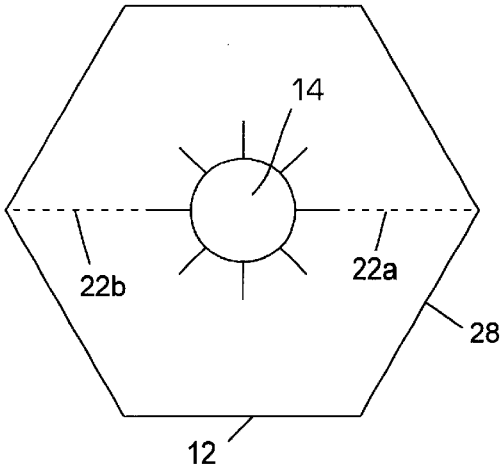
Figure 8D:
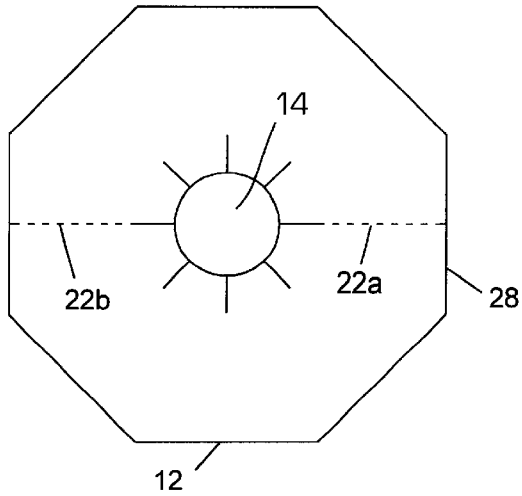

FIGS. 6–7 illustrate embodiments having more than two lines of perforations 22*a-d* so as to allow body 12 to be separated into more than two portions, thereby allowing for more coupons and more sponsors on each coupon vehicle. In that case, the lines of perforations are preferably spaced uniformly around the body so as to allow body 12 to be separated into uniformly sized portions, as in FIG. 7, but they need not be, as in FIG. 6.

Referring again to FIG. 1 Notches 26 are preferably provided at the outer ends of lines of perforations 22*a* and 22*b* to facilitate location of the lines of perforations 22*a* and 22*b* by consumers, and to facilitate portions 24*a* and 24*b* separating at lines of perforations 22*a* and 22*b* when body 12 is flexed in a manner intended to separate portions 24*a* and 24*b*.

Body 12 preferably has a width W that will cause portions 24*a* and 24*b* to have a width that facilitates portions 24*a* and 24*b* fitting easily into the bill holders of cash drawers typically used in cash registers, or into consumers' wallets or coupon holders. For a coupon vehicle 10 having lines of perforations 22*a* and 22*b* that bisect it, the width W is preferably 4.5 to 6 inches.

Body 12 has promotional information incorporated on one or both sides of it, preferably by printing.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims.

What is claimed is:

1. A coupon vehicle installed on a neck of a necked container, the coupon vehicle having at least one coupon-bearing portion, the coupon vehicle comprising:

a relatively thin generally flat body having an outer peripheral edge, an aperture for receiving the neck of the container, and at least one line of perforations in the body extending from the outer peripheral edge to the aperture, the body is not folded along the at least one line of perforations when the coupon vehicle is installed on the neck of the container.

2. The coupon vehicle of claim 1, further comprising a plurality of slits in the body extending outward from the aperture, the slits cooperating with the aperture to form flaps that flex when the coupon vehicle is installed on the neck of a container.

3. The coupon vehicle of claim 2 in combination with a container having a neck and an annular ridge or cap of greater diameter than the neck, wherein the body has an inner edge at the central aperture that engages the neck below the annular ridge or cap; and wherein the flaps flex upwardly in close engagement with the neck of the container when the vehicle is installed downwardly past the ridge or cap to securely attach the vehicle to the container, the vehicle being constructed of resilient material that flexes sufficiently to allow the flaps to pass over the ridge or cap and is sufficiently rigid to separate by fracturing along the at least one line of perforations, whereby the vehicle can fracture along at least one of the at least one line of erforations when lifted upwardly upon engagement of the flaps with the ridge or cap thereby enabling removal of the vehicle from the container necks.

4. The coupon vehicle of claim 2, wherein the aperture is smaller than the neck of the container to securely attach the coupon vehicle to the container.

5. The coupon vehicle of claim 1, wherein the body has an inner edge at the aperture, the edge generally conforming to the circumferential contour of the neck of the container.

6. The coupon vehicle of claim 1, wherein the at least one line of perforations numbers at least two.

7. The coupon vehicle of claim 6, wherein the lines of perforations are uniformly spaced around the body.

8. The coupon vehicle of claim 6, wherein the lines of perforations bisect the coupon vehicle.

9. The coupon vehicle of claim 6, wherein the body has at least two groups of promotional information printed on a side of it, each group of promotional information being arranged between adjacent lines of perforations.

10. The coupon vehicle of claim 1, further comprising a notch on at least one of the at least one line of perforations where it intersects the outer peripheral edge of the body.

11. The coupon vehicle of claim 1, wherein the body is flat.

12. The coupon vehicle of claim 11, wherein the body has a square shape.

13. The coupon vehicle of claim 11, wherein the body has a polygon shape.

14. The coupon vehicle of claim 1, wherein the body is disk-shaped.

15. The coupon vehicle of claim 14, wherein the body has an outer diameter of between approximately 4.5 inches and 6 inches.

16. The coupon vehicle of claim 1, wherein the body is made of a synthetic moisture resistant paper.

17. The coupon vehicle of claim 1, wherein the body has promotional information printed on it.

18. The coupon vehicle of claim 1, further comprising indicia on a surface of the vehicle body, the indicia including information comprising at least one coupon-bearing portion, the indicia being placed such that the coupon-bearing portion is defined oil one side by an edge portion of the aperture and on an adjacent side by one of the at least one line of perforations.

19. The coupon vehicle of claim 18 wherein the at least one line of perforations is a plurality of lines of perforations, the indicia being placed between adjacent lines of perforations to form a plurality of coupon-bearing portions, the indicia being located relative to the lines of perforations and the edge of the aperture such that each coupon-bearing portion is defined in part on one side by an edge portion of the aperture and on each adjacent side by one of the lines of perforations.

20. A coupon vehicle for use on a neck of a necked container, a body having an outer edge;

a substantially circular central aperture for receiving the neck of a container;

a plurality of slits in the body extending outward from the central aperture the slits cooperating with the central aperture to form flaps that flex when the coupon vehicle is installed on the neck of a container; and at least one line of perforations extending from the outer edge to at least one of the slits.

21. A coupon vehicle for use on a neck of a necked container, comprising:

a body having an outer edge;

a substantially circular central aperture for receiving the neck of a container;

a plurality of slits in the body extending outward from the central aperture, the slits cooperating with the central aperture to form flaps that flex when the coupon vehicle is installed on the neck of a container; and at least two lines of perforations extending from the outer edge to the central.

22. A coupon vehicle installed on a neck of a necked container, comprising:

a flat disk-shaped body having an outer peripheral edge;

a central aperture for receiving the neck of the container, the body hiving an inner edge at the aperture generally conforming to the circumferential contour of the neck of a container;

a plurality of slits in the body extending outward from the central aperture, the slits cooperating with the central aperture to form flaps that flex when the coupon vehicle is instilled on a neck of a container;

at least two lines of perforations extending from the outer peripheral edge to the central aperture and bisecting the coupon vehicle, the body being not folded along the at least two lines of perforations when the coupon vehicle is installed on the neck of the container; and a notch at each line of perforations where the line of perforations intersects the outer peripheral edge of the body.

23. A method of mounting a coupon vehicle having at least one sales promotional coupon portion onto a container neck, comprising the steps of:

making a thin coupon vehicle body having an outer peripheral edge, an aperture through the vehicle body, and at least one line of perforations extending from the outer peripheral edge to the aperture; and installing the coupon vehicle downwardly onto the container neck such that the container neck is received in the aperture, the coupon vehicle resists upward removal, and the coupon vehicle is not folded along the at least one line of perforations.

24. The method of claim 23, wherein the aperture conforms tightly to the container neck.

25. The method of claim 23, wherein the coupon vehicle further includes a plurality of flaps adjacent the aperture, and the step of installing further includes the step of flexing the flaps as the coupon vehicle is installed so that the flaps cooperate with the container neck to tightly engage the container neck and securely attach the coupon vehicle to it.

26. The method of claim 25, wherein the container has at least a partial annular ridge or cap of greater diameter than the neck, the flaps are disposed below the ridge or cap, and the resistance to upward removal occurs from the flaps engaging the ridge or cap.

27. The method of claim 26, further comprising the step of fracturing the coupon vehicle along at least one of the at least one line of perforations by lifting the coupon vehicle upward so that the flaps engage the ridge or cap, and flexing the coupon vehicle until said fracturing occurs, whereby said fracturing provides for removal of the coupon vehicle from the container and for use of the sales promotional coupon portions of the coupon vehicle.

28. The method of claim 23, further comprising the subsequent step of separating the vehicle body into at least one coupon portion along at least one of the at least one line of perforations.

29. The method of claim 23, wherein the at least one line of perforations numbers at least two, and the step of making further includes the step of placing indicia to form a coupon portion between adjacent lines of perforations.

30. A method of mounting a coupon vehicle having at least one sales promotional coupon portion on a container neck and subsequently removing the at least one coupon portion at the point of sale, comprising the steps of:

taking a coupon vehicle body having an outer peripheral edge, an aperture and at least one line of perforations extending from the outer peripheral edge to the aperture;

installing the coupon vehicle downwardly onto the container neck such that the container neck is received in the aperture, the coupon vehicle resists upward removal, and the coupon vehicle is not folded along the at least one line of perforations; and then separating the vehicle body along at least one of the at least one line of perforations and removing the at least one coupon portion at the point of sale.

* * * * *

UNITED STATES PATENT AND TRADEMARK OFFICE

CERTIFICATE OF CORRECTION

PATENT NO. : 6,321,473 B1
DATED : November 27, 2001
INVENTOR(S) : Michael Paul Klabunde It is certified that error appears in the above-identified patent and that said Letters Patent is hereby corrected as shown below:

Column 3,
Line 15, the word “flit” should read -- flat --;
Lines 20-30, cancel the paragraph beginning with “Referring to Fig. 1” to and including “or octagonal.”

Column 6,
Line 2, the word “oil” should read -- on --;
Line 15, insert -- comprising: -- after “container,”;
Line 37, insert -- aperture -- after the word “central”;
Line 48, the word “instilled” should read -- installed --.

Column 8,
Line 11, the word “taking” should read -- making --.

Signed and Sealed this

Sixteenth Day of July, 2002

*Attest:*

*Attesting Officer*

JAMES E. ROGAN
*Director of the United States Patent and Trademark Office*